US005125224A

United States Patent [19]

Klaus

[11] Patent Number: 5,125,224

[45] Date of Patent: Jun. 30, 1992

[54] APPARATUS FOR TRANSFERRING YARN PACKAGE TUBES ON A TEXTILE MACHINE

[75] Inventor: Wolfgang Klaus, Ebersbach, Fed. Rep. of Germany

[73] Assignee: Zinser Textilmaschinen GmbH, Ebersbach, Fed. Rep. of Germany

[21] Appl. No.: 658,977

[22] Filed: Feb. 21, 1991

[30] Foreign Application Priority Data

Mar. 21, 1990 [DE] Fed. Rep. of Germany ..... 4005418

[51] Int. Cl.[5] ..... D01H 9/00; D01H 9/04

[52] U.S. Cl. ..... 57/274; 57/264; 57/266; 57/281; 57/276

[58] Field of Search ..... 74/89.15; 192/141, 143; 57/264, 266, 281, 273-275, 276

[56] References Cited

U.S. PATENT DOCUMENTS

| | | | |
|---|---|---|---|
| 3,370,411 | 2/1968 | Schulz et al. | 57/52 |
| 3,751,895 | 8/1973 | Anderson et al. | 57/274 |
| 3,786,621 | 1/1974 | Pray et al. | 57/274 |
| 3,788,054 | 1/1974 | Maussmann et al. | 57/281 |
| 4,144,700 | 3/1979 | Takai et al. | 57/264 |
| 4,294,067 | 10/1981 | Takanisa et al. | 57/274 |

FOREIGN PATENT DOCUMENTS

| | | | |
|---|---|---|---|
| 1292563 | 12/1964 | Fed. Rep. of Germany . | |
| 2158657 | 3/1976 | Fed. Rep. of Germany | 57/281 |
| 1378658 | 11/1971 | United Kingdom . | |

*Primary Examiner*—Daniel P. Stodola
*Assistant Examiner*—William Stryjewski
*Attorney, Agent, or Firm*—Shefte, Pinckney & Sawyer

[57] ABSTRACT

A transferring apparatus for a textile spinning machine for transferring empty tubes and full yarn packages between the spindles on which yarn packages are built and an endless belt for supplying the tubes and discharging full yarn packages. The transferring apparatus includes a tube gripping assembly, a device for vertically moving the tube gripping assembly, a device for laterally moving the tube gripping assembly, and a device for controlling the apparatus to position the tube gripping assembly in a predetermined position relative to the textile spinning machine. The controlling device measures the movement of an operating component, compares the measured value with a predetermined value, and stops the movement of the transferring apparatus in response to an indication that the measured value and the predetermined value are equal. The movement of the operating component corresponds to the vertical and/or lateral movement of the tube gripping assembly. The transferring apparatus can be readily provided with the limits of movement of the tube gripping assembly without the need for mechanical limit switches or the like.

7 Claims, 2 Drawing Sheets

APPARATUS FOR TRANSFERRING YARN PACKAGE TUBES ON A TEXTILE MACHINE

BACKGROUND OF THE INVENTION

The present invention relates to an apparatus for transferring yarn package tubes on a textile machine, and more particularly, to an apparatus for transferring empty tubes and full yarn packages built on tubes between a support means and a plurality of spindles of a textile machine.

In a typical arrangement, a textile spinning or doubling machine includes a plurality of spindles uniformly spaced along the longitudinal extent of the textile machine on at least one side thereof. The spindles individually support tubes during the building of yarn thereon in a yarn package building operation during which full yarn packages are built on the tubes. In one conventional arrangement for supplying empty tubes to the spindles and for transporting full yarn packages from the spindles, an endless belt assembly is provided which includes an endless belt extending parallel to the row of spindles at a spacing therebelow. The endless belt is provided with two series of vertical posts, each post for individually supporting a tube inserted thereon, with the spacing between the vertical posts of each series being at the same uniform spacing as the spacing between the spindles.

The endless belt transports a plurality of empty tubes in upright dispositions to a transfer location below the row of spindles in preparation for transferring full yarn packages from the spindles to the vertical posts of one series of vertical posts and for transferring the empty tubes supported on the other series of vertical posts on the endless belt to the spindles. German patent DE 12 92 563 discloses one known device, commonly referred to as an auto-doffer, for effecting transfer of the empty tubes and full yarn packages between the endless belt and the spindles of a textile machine. The auto-doffer is vertically movable to raise and lower the respective pluralities of empty tubes or full yarn packages supported thereby and, additionally, the auto-doffer is laterally movable in a direction transverse to the row of spindles so that the supported tubes or packages can be moved laterally outwardly of the endless belt to clear the endless belt during the raising and lowering movements.

It is known to provide a plurality of mechanical switches, all connected to a control unit, for signaling the control unit that the auto-doffer has completed respective vertical and lateral movements so that the control unit can control the auto-doffer to commence subsequent vertical and lateral movements. These mechanical switches are adjustable to adjust the positioning of the auto doffer to properly position their gripping devices in relation to the particular tube and package position. The mechanical switches must typically be adjusted to new travel limits in preparation for operating the textile machine to build batches of yarn packages having different characteristics than a prior batch or batches of yarn packages built by the textile machine. Experience has shown that the alignment and adjustment of the mechanical switches requires a relatively high degree of labor and considerable time. Since the textile machine must necessarily be in a standstill condition during any re-adjustment of the mechanical switches, the production efficiency of the textile machine suffers as a result of the re-adjustment of the mechanical switches. Accordingly, the need still exists for an auto-doffer-type device for transferring empty tubes and full yarn packages between the spindles of a textile machines and a transport or support assembly which minimizes the time needed to adjust the auto-doffer to new movement routines.

SUMMARY OF THE INVENTION

The present invention provides an apparatus for transferring empty tubes and full yarn packages which advantageously minimizes the time needed to adjust the apparatus to new movement routines through the use of a controlling means which measures the movement of an operating component of the textile machine and stops the movement of the apparatus in response to an indication that the measured movement equals a predetermined value.

The present invention provides an apparatus for transferring empty tubes and full yarn packages between the support means and the spindles in a textile machine having a longitudinal extent along which a plurality of spindles are uniformly spaced in a row, the spindles for individually supporting tubes during the building of yarn thereon in a package building operation during which full yarn packages are built on the tubes, and a support means extending generally parallel to the row of spindles and vertically spaced therefrom, the support means being operable to support empty tubes in upright dispositions for subsequent transfer of the empty tubes to the spindles and to support full yarn packages in upright dispositions which have been transferred to the support means from the spindles. The transferring apparatus preferably includes a tube gripping assembly having a plurality of individual tube gripping devices each for selectively gripping and releasing an individual tube, the individual tube gripping devices being uniformly spaced from one another at the same spacing as the spindle spacing and means for vertically moving the tube gripping assembly. Also, the transferring apparatus includes, in the preferred embodiment, means for laterally moving the tube gripping assembly relative to the textile machine in a lateral direction transverse to the longitudinal extent of the textile machine, the laterally moving means being operable to move the tube gripping assembly laterally toward and away from the row of spindles during contemporaneous gripping engagement of empty tubes or full yarn packages by the individual tube gripping devices of the tube gripping assembly and the vertically moving means being operable to raise and lower the tube gripping assembly during the contemporaneous gripping engagement of empty tubes or full yarn packages.

In the transferring apparatus, the laterally moving means and the vertically moving means are operable together in coordinated manner to move the tube gripping assembly between a support means adjacent position in which the individual tube gripping devices are selectively operable to grip a plurality of empty tubes supported by the support means or to release a plurality of full yarn packages onto the support means for support thereby and a spindle adjacent position in which the individual tube gripping devices are selectively operable to grip a plurality of full yarn packages supported on the spindles or to release a plurality of empty tubes onto the spindles for support thereby. The preferred embodiment of the transferring apparatus additionally includes means for controlling the transferring apparatus to position the tube gripping assembly in a predetermined position relative to the textile machine, the controlling means including means for measuring the movement of an operating component of a selected one of the laterally moving means and the vertically moving means, the measuring means providing a measured value, means for comparing the measured value with a predetermined value, and stopping means. The stopping means is responsive to the comparing means and operatively connected to the selected one of the laterally moving means and the vertically moving means, for stopping the movement of the transferring apparatus in response to an indication from the comparing means that the measured value of the operating component equals the predetermined value.

According to one aspect of the transferring apparatus, the operating component is an operating component of the vertically moving means and the movement of the operating component varies in proportion to the vertical movement of the tube gripping assembly. Additionally, the tube gripping assembly is movable through a range of movement including an upward vertical movement commencing from a predetermined lower vertical limit and ending at a predetermined upper vertical limit and a downward vertical movement commencing from the predetermined upper vertical limit and ending at the predetermined lower vertical limit and the predetermined value corresponds to the movement which the operating component executes in proportion to the movement of the vertical moving means from one of its upper and lower vertical limits to the other vertical limit, whereby the vertical movement of the vertically moving means is stopped by the controlling means upon the positioning of the vertically moving means at a respective one of its upper and lower vertical limits.

According to another aspect of the present invention, the support means includes a plurality of vertical posts each for individually supporting a tube in an upright disposition when the tube is inserted thereover, the vertical posts being uniformly spaced from one another at the same uniform spacing as the spindle spacing. In this aspect of the present invention, the controlling means includes means for positioning the vertical posts of the support means in alignment with the individual tube gripping devices for transfer of empty tubes or full yarn packages between the vertical posts and the tube gripping devices and means for stopping the support means in response to a determination by the positioning means that the vertical posts of the support means are aligned with the individual tube gripping devices.

According to a further aspect of the transferring apparatus, the operating component is an operating component of the laterally moving means and the movement of the operating component varies in proportion to the lateral movement of the tube gripping assembly.

According to one feature of the preferred embodiment of the transferring appartus, the controlling means includes means for setting the predetermined value, the setting means being operable to designate a predetermined value in association with the positioning of the operating component at a selected position, whereby each position at which the operating component ends a movement can be associated by the setting means with a predetermined value.

BRIEF DESCRIPTION OF THE DRAWINGS

FIGS. 3*a–g* are each schematic side elevational views of the position of the transferring apparatus shown in FIGS. 1 and 2 at a respective stage of a transferring operation in which the transferring apparatus transfers a plurality of empty tubes from the row of spindles to the support means.

DESCRIPTION OF THE PREFERRED EMBODIMENT

Figure 1:
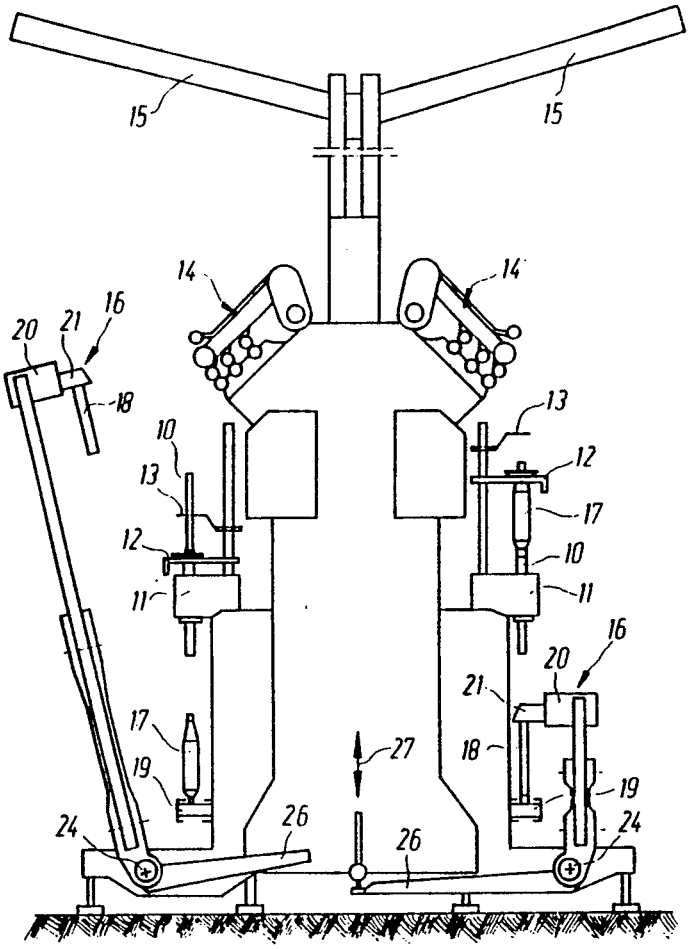
FIG. 1 is a schematic end view of a textile ring spinning machine incorporating the preferred embodiment of the transferring apparatus of the present invention.
Figure 2:
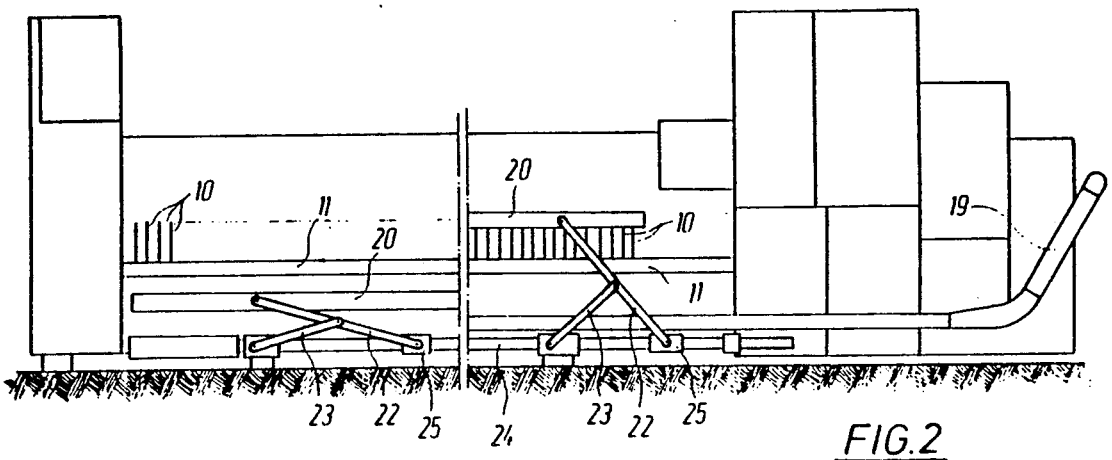
FIG. 2 is a schematic front elevational view of the textile ring spinning machine shown in FIG. 1 and showing, in the left-hand portion of the figure, the transferring apparatus of the present invention in its spindle adjacent position and, in the right-hand portion of the figure, the transferring apparatus in its support means adjacent position.

In FIGS. 1–4, the preferred embodiment of the transferring apparatus 16 of the present invention is illustrated in its operational disposition on a conventional textile ring spinning machine. The textile ring spinning machine, as seen in FIGS. 1 and 2, includes a pair of rows of spindles 10, the spindles in each row of spindles being uniformly spaced from one another along a spindle bank 11 on a respective side of the ring spinning machine. A plurality of drafting rollers 14 are associated with each row of the spindles 10, each drafting roller 14 for drafting yarn therethrough from roving yarn packages (not shown) which are supported in suspended disposition from a pair of creels 15 during feeding of yarn onto tubes supported on the spindles 10. The yarn drafted through each drafting roller 14 is guided by a conventional yarn guide element 13 and is fed by a ring traveler on a ring bank 12 in conventional package building manner onto a tube supported on a spindle 10 for the building of a full yarn package onto the tube.

The ring spinning machine includes support means for supporting empty tubes in upright dispositions for subsequent transfer of the empty tubes to the spindles 10 and for supporting full yarn packages in upright dispositions which have been transferred to the transport means from the spindles 10. The support means is in the form of a pair of endless belt assemblies 19 each having an endless belt extending along one respective side of the ring spinning machine parallel to the respective row of spindles 10 at a location below the row of spindles and vertically aligned therewith. Each endless belt has a first series of vertical posts for supporting empty tubes thereon and a second series of vertical posts for supporting full yarn packages thereon. The posts of each respective series are at a uniform spacing from one another equal to the spindle spacing. Each vertical post of a respective series of the vertical posts is disposed intermediate an adjacent pair of vertical posts of the other series of vertical posts at a spacing corresponding to one-half the uniform spindle spacing from each of the adjacent vertical posts. Each endless belt is operatively connected to a conventional belt drive motor (not shown) for driving operation of the endless belt to transport empty tubes in upright dispositions to aligned transfer positions for subsequent transfer of the empty tubes 18 to the spindles 10 and to discharge the full yarn packages 17 which have been transferred from the spindles 10 to the endless belt to a further handling location.

The description of the transferring apparatus of the present invention which follows is in terms of one unit of the transferring apparatus for performing transfer operations on one respective side of the ring spinning machine, it being understood that a similarly configured unit of the transferring apparatus is disposed for performing transferring operations on the other side of the ring spinning machine.

The transferring apparatus 16 is operable to transfer the empty tubes 18 and the full yarn packages 17 between the endless belt of the endless belt assembly 19 and the row of the spindles 10. The transferring apparatus 16 includes a tube gripping assembly 20 having a plurality of individual tube gripping devices 21 each operable to selectively grip and release an individual empty tube 18 or an individual full yarn package 17. The individual tube gripping devices 21 are uniformly spaced from one another at the same spacing as the uniform spacing between the spindle 10.

Figure 3A:
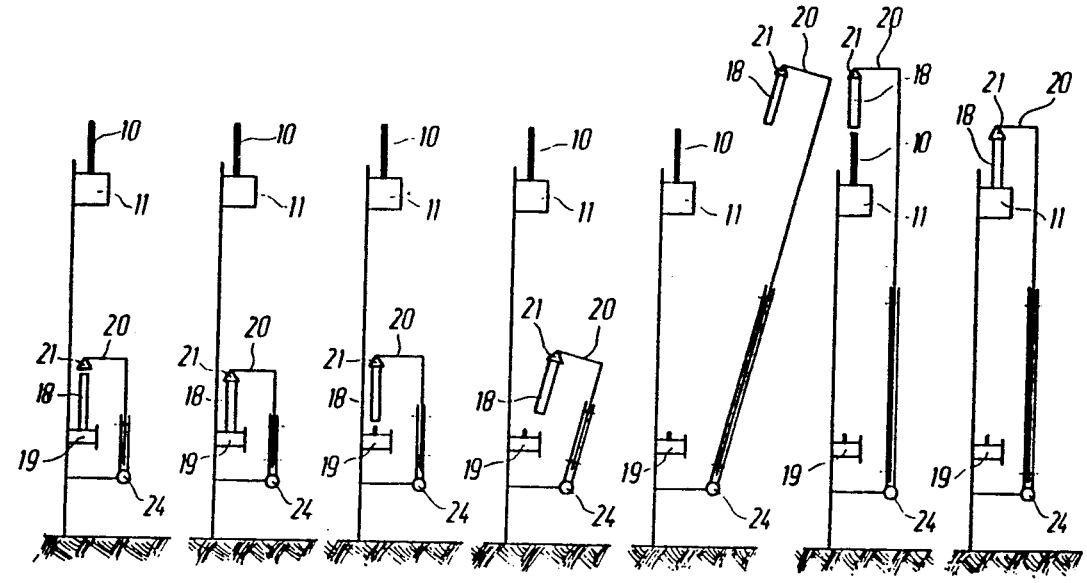
Figure 4:
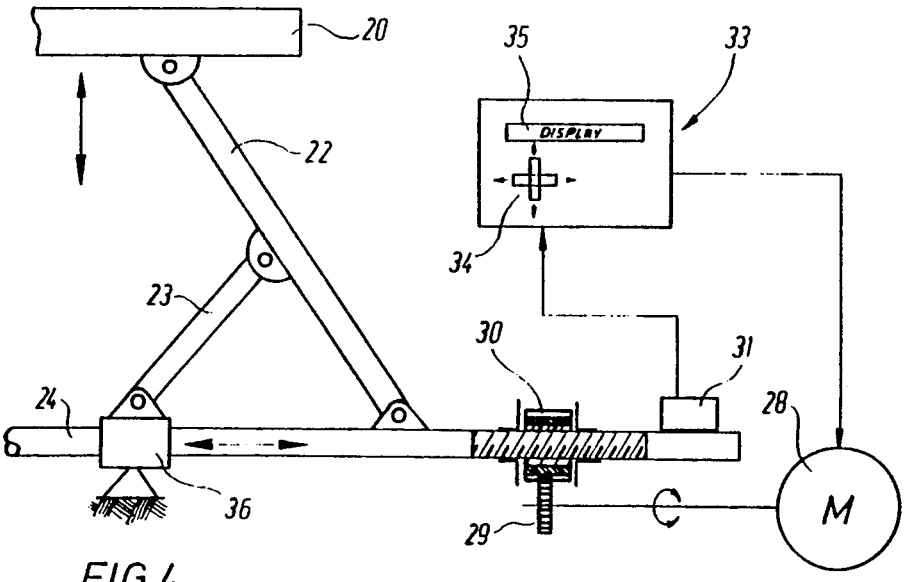
FIG. 4 is an enlarged front elevational view of the portion of the transferring apparatus shown in FIG. 2.

As best seen in FIGS. 2–4, the transferring apparatus 16 includes a means for vertically moving the tube gripping assembly 20 in the form of scissor-type assembly including a first rod 22 pivotally connected at one end to the tube gripping assembly 20 and pivotally connected at its other end to a sleeve 25, a constraining rod 23, and a fixed support member 36, as seen in FIG. 4. The sleeve 25 is mounted in encircling relation around the drive rod 24 of a drive rod assembly 24' and is operatively interconnected to the drive rod 24 for axial movement therewith while permitting independent pivoting of the drive rod 24 about its axis without any corresponding movement of the sleeve.

The drive rod 24 of the vertically moving means is axially moved by an arrangement which includes a worm thread formed along an axial extent of the drive rod, a gear 30 having a threaded inner bore configured for meshing engagement with the worm thread portion of the drive rod and an external annular portion having threads formed thereon for meshing engagement with a drive gear 29. The drive gear 29 is operatively interconnected to a drive motor 28 for driving operation thereof. To effect axial movement of the drive rod 24, the drive motor 28 is operated to rotate the drive gear 29 which produces corresponding rotation of the gear 30. The internal threaded bore of the gear 30 meshingly engages the worm thread portion of the drive rod 24 to axially displace the drive rod 24 in correspondence with rotation of the gear 30.

The transferring apparatus 16 also includes a laterally moving means operable to move the tube gripping assembly 20 laterally toward and away from the row of spindles 10 during contemporaneous gripping engagement of the empty tubes 18 or the full yarn packages 17 by the individual tube gripping devices 21 of the tube gripping assembly 20. As seen in FIG. 1, the laterally moving means includes a plurality of conventional pivot mounting means (not shown) for mounting the drive rod 24 with its axis extending parallel to the row of the spindles 10 for pivoting movement of the drive rod about its axis and a moment arm 26 fixedly connected at on end to the drive rod 24 and at its other end to one end of a vertical drive rod 27. The other end of the vertical drive rod 27 is operatively interconnected to a conventional drive means 37 such as, for example, a conventional hydraulic cylinder, for selectively raising and lowering the vertical drive rod 27 along a vertical axis. When the vertical drive rod 27 is lowered, the moment arm 26 causes the gripping assembly 20 to be moved laterally toward the ring spinning machine. machine. When the vertical drive rod 27 is raised, the moment arm 26 causes the tube gripping assembly 20 to be moved laterally away from the ring spinning machine.

As seen in FIGS. **3*a–g*, the laterally moving means and the vertically moving means are operable together in coordinated manner to move the tube gripping assembly 20 in a sequence of movements between a support means adjacent position, shown in FIG. 3*a*, in which the individual tube gripping devices 21 are selectively operable to grip a plurality of the empty tubes 18 supported by the support means (or to release a plurality of the full yarn packages 17 onto the support means for support thereby) and a spindle adjacent position, shown in FIG. 3*g*, in which the individual tube gripping devices 21 are selectively operable to release a plurality of the empty tubes 18 onto the spindles 10 for support thereby (or to grip a plurality of the full yarn packages 17 supported on the spindles 10). The sequence of movements of the transferring apparatus as illustrated in FIGS. 3*a–g*** representatively depict the coordinated operation of the laterally moving means and the vertically moving means.

The illustrated sequence of movements are the movements executed by the transferring apparatus in transferring a plurality of the empty tubes 18 from the endless belt of the endless belt assembly 19 to the respective row of the spindles 10. To prepare for initial gripping engagement of the empty tubes 18 by the individual tube gripping device 21, the vertically moving means is operated to lower the tube gripping assembly 20 to a predetermined vertical position in which the individual tube gripping devices 21 are supported immediately above the tops of the empty tubes 18. As shown in FIG. **3*b*, the vertically moving means is then operated to effect lowering of the tube gripping assembly 20 from the predetermined vertical position shown in FIG. 3*a* to another vertical position in which the individual tube gripping devices 21 are positioned in engagement with the tops of the empty tubes 18 so that the individual tube gripping devices can be operated to grip the empty tubes 18. The lowering of the tube gripping assembly 20 by the vertically moving means is accomplished by appropriate axial movement of the drive rod 24 which effects corresponding movement of the first rod 22 through the axial movement of sleeve 25 with the drive rod 24**.

As shown in FIG. **3*c*, the vertically moving means is then operated to raise the tube gripping assembly 20 to a further predetermined vertical position in which the empty tubes 18, which are now grippingly engaged by the individual tube gripping devices 21, are raised out of interference with the vertical posts on the endless belt of the endless belt assembly 19** to an extent sufficient to permit subsequent outward lateral movement of the empty tubes relative to the textile machine.

As shown in FIG. **3*d*, the next sequence of movements is a lateral movement of tube gripping assembly 20 outwardly from the ring spinning machine by the laterally moving means and this movement is effected by appropriate raising of the vertical drive rod 27. The extent of the lateral movement of the tube gripping 20 is selected to permit subsequent vertical movement of the tube gripping assembly vertically beyond the row of the spindles 10 without interference between the tube gripping assembly 20 or the gripped empty tubes 18 and the spindle bank 11**.

As shown in FIG. 3*e*, the next sequence of movement involves raising of the tube gripping assembly 20 by the vertically moving means to yet another predetermined vertical position at which the gripped tubes 18 are supported by the individual tube gripping devices 21 at a location upwardly and laterally spaced from the row of the spindles 10 for subsequent lateral movement of the gripped empty tubes into vertical alignment with the spindles 10.

As shown in FIG. 3*f*, the laterally moving means is then operated to laterally move the tube gripping assembly 20 toward the ring spinning machine to a position in which the gripped empty tubes 18 are supported immediately above the spindles 10 with each gripped empty tube 18 in alignment with a respective one of the spindles 10 for subsequent insertion thereon.

As shown in FIG. 3*g*, the final movement in the illustrated sequence of movements is the lowering of the gripped empty tubes 18 onto the respective aligned spindles 10 and this lowering movement is effected through lowering of the tube gripping assembly 20 by the vertically moving means to the predetermined vertical position shown in FIG. 3*g*. In correspondence with the insertion of the gripped empty tubes 18 onto the spindles 10, the individual tube gripping devices 21 are operated to release the gripped empty tubes so that the empty tubes are thereafter entirely supported by the spindles 10. The transferring apparatus is then available for subsequent transferring operations such as, for example, a transferring operation after full yarn packages are built on the empty tubes 18 in which the full yarn packages are transferred from the spindles 10 to the endless belt of the endless belt assembly 19.

As seen in FIG. 4, the transferring apparatus additionally includes means for controlling the apparatus to position the tube gripping assembly 20 in a predetermined position relative to the ring spinning machine. The controlling means includes a control unit 33 operatively connected to the drive motor 28 and a movement sensor 31 operatively connected to the control unit 33. The control unit 33 includes a display component 35 and a cursor component 34. The movement sensor 31 is positioned adjacent the drive rod 24 of the vertically moving means and is operable to sense the magnitude of axial movement of the drive rod 24.

The controlling means is initially provided by an operator with the predetermined vertical limits or positions to which the tube gripping assembly 20 is moved. The operator manipulates the cursor component 34 to effect operation of the motor 28 such that the tube gripping assembly 20 is moved to the particular predetermined vertical position to be provided or inputted to the control unit 33. Once the tube gripping assembly 20 is in the selected predetermined vertical position, the operator ceases manipulation of the cursor component 34 and manipulates a conventional input storage member (not shown) on the control unit 33 to designate a particular predetermined value which corresponds to the predetermined vertical limit at which the tube gripping assembly 20 is positioned. Additionally, the control unit 33 stores information transmitted thereto by the movement sensor 31 relating to the magnitude of axial movement through which the drive rod 24 has moved relative to a baseline value during the movement of the tube gripping assembly 20 from one vertical limit to the selected predetermined vertical limit. The control unit 33 associates the information received from the movement sensor 31, which is preferably in the form of a measured value, with the designated predetermined value associated with the selected predetermined vertical limit.

After the relevant information relating to the selected predetermined vertical limit has been stored by the control unit 33, the operator again manipulates the cursor component 34 to effect movement of the tube gripping assembly 20 to the next predetermined vertical limit which occurs in the sequence of movements of the particular transferring operation. The operator then repeats the inputting process to include the steps of designating the predetermined vertical limits and the storing operations with respect to the control unit 33. The display component 35 displays the stored information stored in the control unit 33 so the operator can, if desired, record and/or verify the stored information. For example, the control unit can be programmed to store the predetermined vertical limits information in the event that the operator desires to program the control unit 33 at a later time to perform the same transferring operation.

The control unit 33 is thereby provided upon the completion of the inputting process with a series of designated predetermined values, each corresponding to a selected predetermined vertical limit, and each predetermined value having associated therewith information concerning the corresponding axial movement of the drive rod 24 from the immediately prior predetermined vertical limit to the predetermined vertical limit associated with the respective predetermined value. Accordingly, the control unit 33 is ready to control the movement of the vertically moving means to effect sequential movement in a predetermined manner of the tube gripping assembly 20 to the several predetermined vertical limits of the particular transferring operation.

For example, the control unit 33 may have previously been provided with information concerning the sequential vertical movements of the tube gripping assembly 20 in a transferring operation in which the transferring apparatus transfers a plurality of the full yarn packages 17 from the spindles 10 to the endless belt of the endless belt assembly 19. In this transferring operation, the transferring apparatus essentially executes the sequence of movements illustrated in FIGS. 3*a–f* in reverse manner. Specifically, the vertically moving means positions the tube gripping assembly 20 at the predetermined vertical limit shown in FIG. 3*f* at which each of the individual tube gripping devices 21 is supported in alignment above a respective one of the full yarn packages 17 supported on one of the spindles 10. Then the control unit 33 controls the drive motor 28 to effect lowering of the tube gripping assembly to another predetermined vertical limit at which the individual tube gripping devices 21 are each in engagement with the top of the associated aligned full yarn package 17 for subsequent gripping engagement thereof.

During the movement of the drive rod 24 to effect lowering of the tube gripping 20 from the predetermined vertical position or limit shown in FIG. 3*f* to the subsequent predetermined vertical limit shown in FIG. 3*g*, the movement sensor 31 senses the relative axial movement of the drive rod 24 and transmits a measured value to the control unit 33, which continuously compares the most recently received measured value with the predetermined value corresponding to the subsequent predetermined vertical limit. In correspondence with a determination that the measured value equals the predetermined value, the control unit 33, through its stopping means, signals the drive motor 28 to stop the vertical movement of the tube gripping assembly 20. The control unit 33 controls the sequentially following vertical movements of the tube gripping assembly 20 to the several predetermined vertical limits as the transferring apparatus completes the sequence of movements to transfer the full yarn packages 17 from the spindles 10 to the vertical posts of the endless belt of the endless belt assembly 19.

The controlling means of the transferring apparatus therefore reliably and accurately controls the vertical movement of the tube gripping assembly 20 between and among its several predetermined vertical limits during each transferring operation. Also, the control unit 33 can be readily provided with information concerning the predetermined vertical limits of a new transferring operation such as, for example, a new transferring operation associated with the building of batch of yarn packages having different characteristics than a previous batch.

The present invention also contemplates that the controlling means can be configured to control the lateral movement of the transferring apparatus. For example, the movement sensor 31 can be configured to sense the pivotal or angular movement of the drive rod 24 about its axis relative to a baseline pivot value. In a similar manner as described with respect to the inputting of the predetermined limits, an operator can program the control unit 33 to associate each predetermined angular limit of the drive rod 24 with a particular measured angular value as measured by the moving sensor 31. To effect stopping of the laterally moving means in correspondence with a determination by the control unit 33 that a measured angular value provided by the moving sensor 31 is equal to a predetermined angular value stored in the control unit, the control unit 33 can be operatively connected to a conventional movement stopping means 38 such as, for example, a conventional valve assembly which regulates the supply of hydraulic fluid to and from the hydraulic cylinder which drives the vertical drive rod 27. If the control unit 33 is configured to control both the movement of the vertically moving means and the movement of the laterally moving means, the control unit 33 can essentially control the entire sequence of lateral and vertical movements of the transferring apparatus in a transferring operation.

The present invention additionally contemplates that the movement of the endless belt of the endless belt assembly 19 can be controlled by the controlling means. A movement sensor 39 is provided adjacent the endless belt for sensing travel of the endless belt and the endless belt movement sensor 39 includes conventional sensing means operatively connected to the control unit 33 to provide information concerning the relative movement of the endless belt relative to a baseline endless belt value. Since the endless belt is provided with two series of vertical posts, each series of vertical posts for receiving a respective plurality of the full yarn packages 17 thereon or a respective plurality of the empty tubes 18 thereon the control unit 33 can be configured to control the travel of the endless belt to effect positioning of a selected one of the series of vertical posts for receiving the designated plurality of full yarn packages or empty tubes thereon.

Accordingly, the control unit 33 controls the endless belt to travel through a displacement corresponding to one-half the uniform spindle spacing to position the other series of vertical posts for receipt of the respective empty tubes or full yarn packages to be inserted thereon following the transfer of the empty tubes or full yarn packages to the other series of other vertical posts. The endless belt movement sensor transmits information to the control unit 33 concerning the magnitude of displacement of the endless belt during its travel and the control unit, which is operatively connected by a conventional connector (not shown) to the drive means of the endless belt assembly 19, stops the travel of the endless belt upon determining that the measured value received from the endless belt movement sensor is equal to a predetermined value stored in the control unit 33. The control unit 33 can accordingly control the movement of the endless belt as well to ready the endless belt for the receipt of the next plurality of empty tubes or full yarn packages to be transferred in the upcoming transferring operation.

The description of the transferring apparatus of the present invention which follows is in terms of one unit of the transferring apparatus for performing transfer operations on one respective side of the ring spinning machine, it being understood that a similarly configured unit of the transferring is disposed for performing transferring operations on the other side of the ring spinning machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile machine having a longitudinal extent along which a plurality of spindles are uniformly spaced in a row, the spindles for individually supporting tubes during the building of yarn thereon in a package building operation during which full yarn packages are built on the tubes, and a support means extending generally parallel to the row of spindles and vertically spaced therefrom, the support means being operable to support empty tubes in upright dispositions for subsequent transfer of the empty tubes to the spindles and to support full yarn packages in upright dispositions which have been transferred to the support means from the spindles, an apparatus for transferring empty tubes and full yarn packages between the support means and the spindles, comprising:

a tube gripping assembly having a plurality of individual tube gripping devices each for selectively gripping and releasing an individual tube, the individual tube gripping devices being uniformly spaced from one another at the same spacing as the spindle spacing; assembly relative to the textile machine in a lateral direction transverse to the longitudinal extent of the textile machine, the laterally moving means being operable to move the tube gripping assembly laterally toward and away from the row of spindles during contemporaneous gripping engagement of empty tubes or full yarn packages by the individual tube gripping devices of the tube gripping assembly and the vertically moving means being operable to raise and lower the tube gripping assembly during the contemporaneous gripping engagement of empty tubes or full yarn packages, the laterally moving means and the vertically moving means being operable together in coordinated manner during a tube gripping operation to move the tube gripping assembly between a support means adjacent position in which the individual tube gripping devices are selectively operable to grip a plurality of empty tubes supported by the support means or to release a plurality of full yarn packages onto the support means for support thereby and a spindle adjacent position in which the individual tube gripping devices are selectively operable to grip a plurality of full yarn packages supported on the spindles or to release a plurality of empty tubes onto the spindles for support thereby; and means for controlling the transferring apparatus to position the tube gripping assembly in a predetermined position relative to the textile machine, the controlling means including means for measuring the movement of an operating component of a selected one of the laterally moving means and the vertically moving means along an operating component travel path, the measuring means being operable to sense the movement of the operating component along its travel path past a sensing location, the measuring means being operable to generate a series of measured values at sequential measuring operations with each measured value being generated during one measuring operation and the sensing location being a single location on the travel path such that a different portion of the operating component is traveling past the sensing location each time the measuring means performs a measuring operation and all of the measured portions of the operating component travel past the sensing location during each tube gripping operation and each measured value corresponding to a respective instantaneous position of a fixed point on the operating component relative to the sensing location, the fixed point being at a different instantaneous position each time the measuring means performs a measuring operation such that no more than one measured value corresponds to the respective instantaneous position of the fixed point at the sensing location and the remaining measured values correspond to instantaneous positions of the fixed point displaced from the sensing location, means for comparing the measured values with a predetermined value, and stopping means responsive to the comparing means and operatively connected to the selected one of the laterally moving means and the vertically moving means, for stopping the movement of the transferring apparatus in response to an indication from the comparing means that a measured value provided by the measuring means equal the predetermined value.

2. In a textile machine, the transferring apparatus according to claim and characterized further in that the operating component is an operating component of the vertically moving means and the movement of the operating component varies in proportion to the vertical movement of the tube gripping assembly.

3. In a textile machine, the transferring apparatus according to claim 2 and characterized further in that the tube gripping assembly is movable through a range of movement including an upward vertical movement commencing from a predetermined lower vertical limit and ending at a predetermined upper vertical limit and a downward vertical movement commencing from the predetermined upper vertical limit and ending at the predetermined lower vertical limit and the predetermined value corresponds to the movement which the operating component executes in proportion to the movement of the vertical moving means from a selected one of its upper and lower vertical limits to the other of its upper and lower limits, whereby the vertical movement of the vertically moving means is stopped by the controlling means upon the positioning of the vertically moving means at a respective one of its upper and lower vertical limits.

4. In a textile machine, the transferring apparatus according to claim 3, and characterized further in that the operating component is a drive arm movable along its axis to effect corresponding movement of the tube gripping assembly through its range of movement and the measuring means includes means for measuring the axial movement of the drive arm.

5. In a textile machine, the transferring apparatus according to claim 1 wherein the support means includes a plurality of vertical posts each for individually supporting a tube in an upright disposition when the tube is inserted thereover, the vertical posts being uniformly spaced from one another at the same uniform spacing as the spindle spacing, and characterized further in that the controlling means includes means for positioning the vertical posts of the support means in alignment with the individual tube gripping devices for transfer of empty tubes or full yarn packages between the vertical posts and the tube gripping devices and means for stopping the support means in response to a determination by the positioning means that the vertical posts of the support means are aligned with the individual tube gripping devices.

6. In a textile machine, the transferring apparatus according to claim 1 and characterized further in that the operating component is an operating component of the laterally moving means and the movement of the operating component varies in proportion to the lateral movement of the tube gripping assembly.

7. In a textile machine, the transferring apparatus according to claim and characterized further in that the controlling means includes means for setting the predetermined value, the setting means being operable to designate a predetermined value in association with the positioning of the operating component at a selected position, whereby each position at which the operating component ends a movement can be associated by the setting means with a predetermined value.

* * * * *